United States Patent [19]

Sardemann et al.

[11] 4,149,580

[45] Apr. 17, 1979

[54] METHOD OF ASCERTAINING THE EFFECTIVENESS OF COOLING ROLLERS IN CONTINUOUS CASTING MACHINES

[75] Inventors: Jürgen Sardemann, Essen-Kettwig; Klaus Wünnenberg, Duisburg, both of Fed. Rep. of Germany

[73] Assignee: Mannesmann Aktiengesellschaft, Dusseldorf, Fed. Rep. of Germany

[21] Appl. No.: 860,306

[22] Filed: Dec. 14, 1977

[30] Foreign Application Priority Data

Dec. 14, 1976 [DE] Fed. Rep. of Germany ..... 2657068

[51] Int. Cl.[2] ..... B22D 11/124

[52] U.S. Cl. ..... 164/4; 164/443

[58] Field of Search ..... 164/4, 150, 414, 443; 73/343 R

[56] References Cited

U.S. PATENT DOCUMENTS

| | | | |
|---|---|---|---|
| 3,358,743 | 12/1967 | Adams | 164/414 X |
| 3,614,978 | 10/1971 | Kosco | 164/414 |
| 3,731,536 | 5/1973 | Baumann et al. | 164/150 X |

*Primary Examiner*—Othell M. Simpson
*Assistant Examiner*—K. Y. Lin
*Attorney, Agent, or Firm*—Smyth, Pavitt, Siegemund, Jones & Martella

[57] ABSTRACT

Effectiveness of internal cooling of the rollers in a withdrawal path for continuously cast ingots is determined by measuring the drop in surface temperature of the ingot when in engagement with the rollers. For this, a thermo element is affixed to the ingot's surface and its output is recorded or otherwise processed.

3 Claims, 3 Drawing Figures

METHOD OF ASCERTAINING THE EFFECTIVENESS OF COOLING ROLLERS IN CONTINUOUS CASTING MACHINES

BACKGROUND OF THE INVENTION

The present invention relates to a method for ascertaining the effectiveness of cooling the withdrawal rollers in a continuous casting machine, particularly a machine for continuous casting of steel.

Upon continuously casting steel ingots, the ingot as emerging from the bottom of the mold has a solidified skin or shell while the interior of the ingot is still liquidous. The shell is, of course, subjected to a ferrostatic pressure because the liquidous steel in the withdrawn ingot still communicates with the molten bath in the mold and, therefore, is subjected to the ferrostatic pressure of that entire liquid column. Therefore, the ingot and particularly the pressurized skin or shell thereof, has to be supported by rollers which also withdraw the ingot from the mold. Of course, it is necessary to make sure that the rollers do not damage the skin of the ingot. Therefore, these rollers must run smoothly and centrally without wobbling.

The rollers employed in continuous casting stands are usually required to be water cooled, particularly from the inside. Moreover, cooling must occur at a particular rate, and it is a requirement for such a system to make sure that the rolls are continuously being cooled at that rate. Otherwise, a high temperature may damage the rollers in some fashion. For example, hot bearings will wear rapidly; otherwise unimportant flaws may become more pronounced; and the rolls may bend.

It is customary to connect these support rollers in groups to a suitable conduit for the coolant, i.e. a source of water, and the flow of water is continuously monitored. Should a water feed path to or even in a roller be defective, clogged or otherwise impeded, it is difficult to ascertain the deficiency in cooling of that particular roller because the sum total of the amount of water fed to the group may vary only insignificantly. Moreover, small deviations in the coolant flow cannot be used directly as an indication for the cooling (or lack of it) of an individual roller. The obvious solution to this problem is to provide each roller with its own supervising equipment as to the flow of water. However, that approach is obviously very expensive.

DESCRIPTION OF THE INVENTION

It is an object of the present invention to overcome and avoid the deficiencies outlined above and to suggest a rather simple method for ascertaining whether or not an individual roller in an ingot withdrawing path of a machine for continuous casting is or is not sufficiently cooled.

In accordance with the preferred embodiment of the present invention it is suggested to measure the surface temperature of the ingot as withdrawn, by means of thermo feelers such as thermo elements placed on the surface of the ingot, and to provide particularly such measurement during periods of contact of the ingot with the several rollers. The resulting signal train is correlated with the individual rolls as passed by the ingot. The invention is based on the discovery that an internally cooled roller, even though being in contact with the ingot for a short period of time only, will cool the surface of the ingot along the line of contact. This phenomenon, i.e. the drop in surface temperature, will be the more pronounced the more powerfully the rollers are cooled. Uncooled or insufficiently cooled rollers, however, will be heated more by the hot ingot upon engagement therewith, so that the considerably reduced temperature gradient or temperature difference between roller and ingot cools the latter very little or not at all. In other words, the thermo feeler will experience a smaller temperature drop when contacting an insufficiently cooled roller. Thus, upon measuring the surface temperature of the ingot as it passes the several rollers, one obtains directly information on the cooling power and the extent of the cooling effectiveness of each individual rollers, so that rollers with defective, impeded or even interrupted cooling can be recognized immediately.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings which:

Proceeding now to the detailed description of the drawings, FIG. 1 illustrates a continuous casting or ingot 1 as it is being withdrawn from the mold which is disposed above the area as shown in FIG. 1. In a manner described more fully below, a thermo element 2 having its "hot" measuring tip 3 encased in a small tube 4, capsule or the like has been affixed to the surface of the ingot 1. The thermo element 2, hot measuring point 3 and container capsule 4 has been placed onto the ingot preferrably right after the ingot has left the mold and before engaging the first withdrawal roller of the set of rollers 8. That first roller has forced the measuring point into the surface of the ingot and now it propagates with the ingot through the withdrawal stand of the continuous casting machine. Flexible conductors 6 lead to the thermo element to provide a signal to a signal processing device 7 which may include a recorder.

It can be seen that the surface temperature of the ingot will be monitored at that particular point to which the thermo element is affixed on a running and continuous basis. On the other hand, the thermo element 2 monitors also indirectly the temperature of the rollers, to the extent any engagement of the ingot with a roller modifies the local surface temperature of the ingot. Generally, speaking, the balance of heat influx and outflow of the affixed thermo element as it is normally exposed to ambient air or to the spray of coolant or the like, is altered in some fashion as that particular surface portion of the ingot engages a particular roller.

Figure 1:
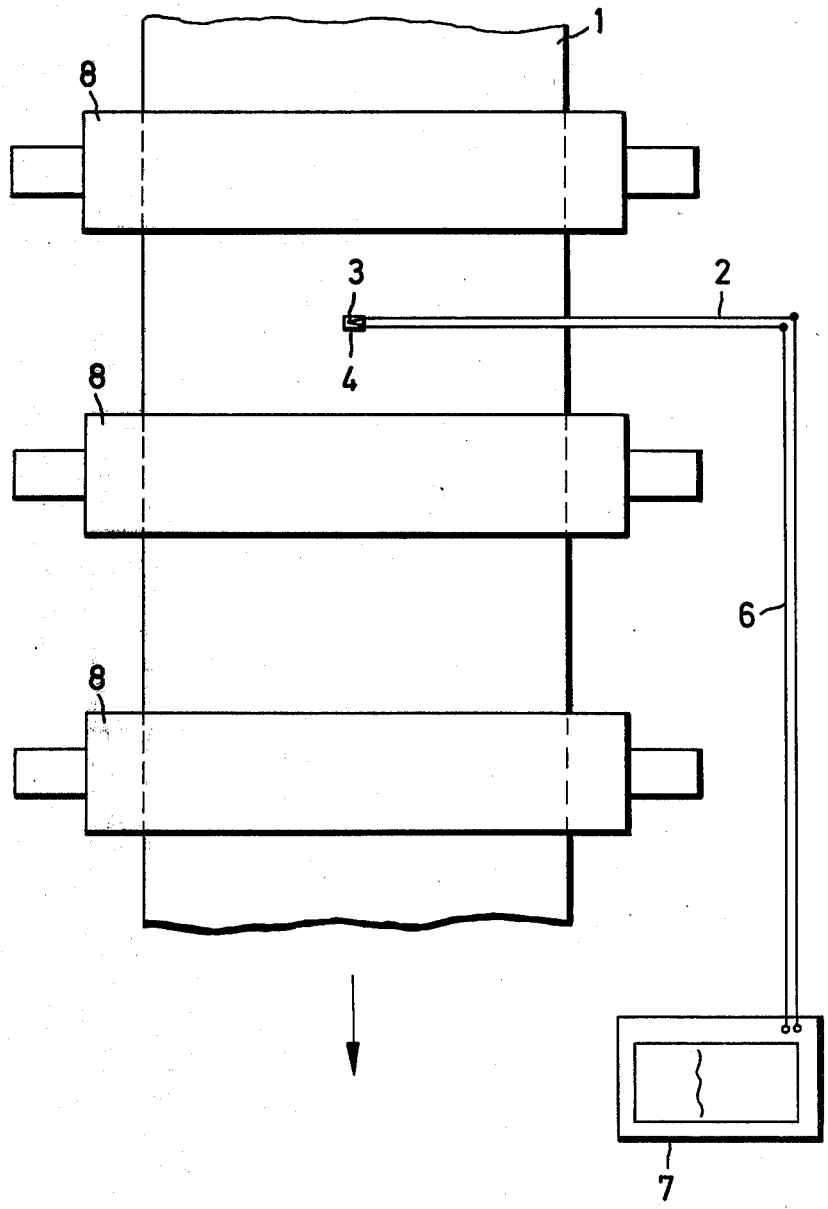
FIG. 1 illustrates somewhat schematically a withdrawal stand for an ingot underneath a mold for continuous casting showing just three rollers.
Figure 2:
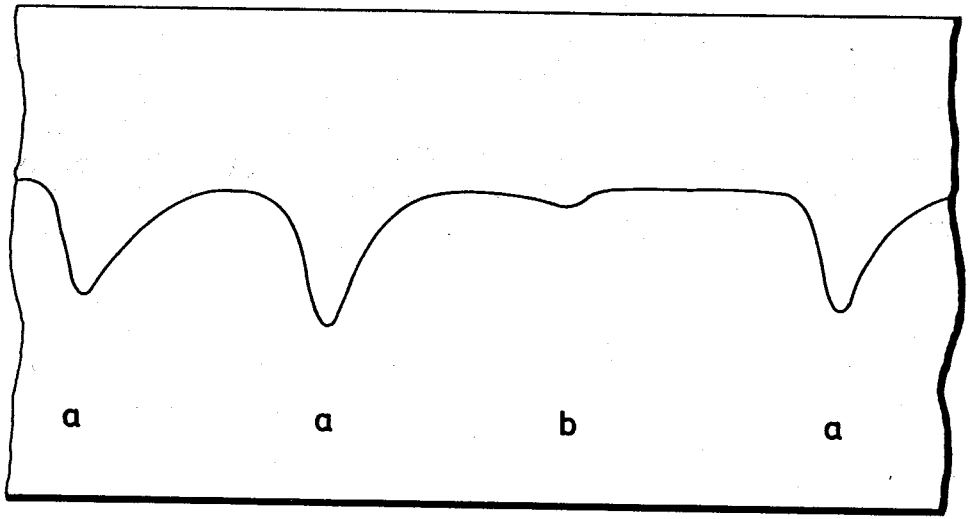
FIG. 2 is a graph in which temperature is plotted along and against the withdrawal path for an ingot, including particularly the portion of the path illustrated in FIG. 1.

Turning now to FIG. 2, the resulting output voltage of the thermo element being proportionally (or at least monotonically) related to surface temperature, has been plotted against time. Since the rollers are normally very intensively cooled, the thermo element should experience a significant temperature drop when passing any such roller. The situations a show that indeed the temperature has dropped in three instances, i.e. in three cases the thermo element signaled a significant temperature drop when passing a roller. By way of example the surface temperature may drop by at least 30° C. In cases of very strong cooling, the temperature drop may be as steep as 200° C.

The situation b in FIG. 2 illustrates the case of a roller in which the cooling was interrupted or at least significantly impeded so that the temperature drop is only an insignificant one. It was found in practice that these comparative measuring results yield a very accurate and sensitive indication of the degree of cooling the rollers experience.

Since one knows at what point in time the thermo element (following its being affixed to the ingot) began to measure, a plotted chart such as shown in FIG. 2 permits ready correlation between signal dips and rollers. Also, one knows the withdrawal speed of the ingot as well as the speed of the stops chart. Thus, the roller that was sufficiently cooled (case b) is readily identified.

Since all rollers (or at least neighboring rollers) are approximately similarly cooled, a simple visual comparison permits ready detection of an inadequately cooled roller. In a more sophisticated device, one may digitize the signal train from the thermo element, and by means of signal processing (device 7 can be so interpreted) the drop in signal level as detected for each roller is compared with a signature reference of that particular roller to determine any cooling defect. This way one may detect already rather early the onset of clogging in the cooling ducts or the like.

One can readily see that it is optional how frequently such supervision is to be taking place. One just affixes thermo elements to the surface of the ingot whenever the need is felt for such supervision and monitoring operation. Therefore, the signal processing may include storage of previous test runs, and comparing of new data with stored ones. One may also provide for an indication whether or not the expected temperature drop exceeds a prescribed minimum of, say, 20° C.

The resulting signal may be plotted as shown schematically in FIG. 2, and the recording strip readily yields at a first glance a defect or impairment in the cooling operation. In the case of signal processing one may plot only changes from reference data and/or from previous runs. Therefore, one can identify very quickly the individual rollers as to their state of cooling. Since the rollers are provided on both sides of the ingot, both sides or both surfaces of the ingot should be provided with such thermo elements accordingly.

Figure 3:
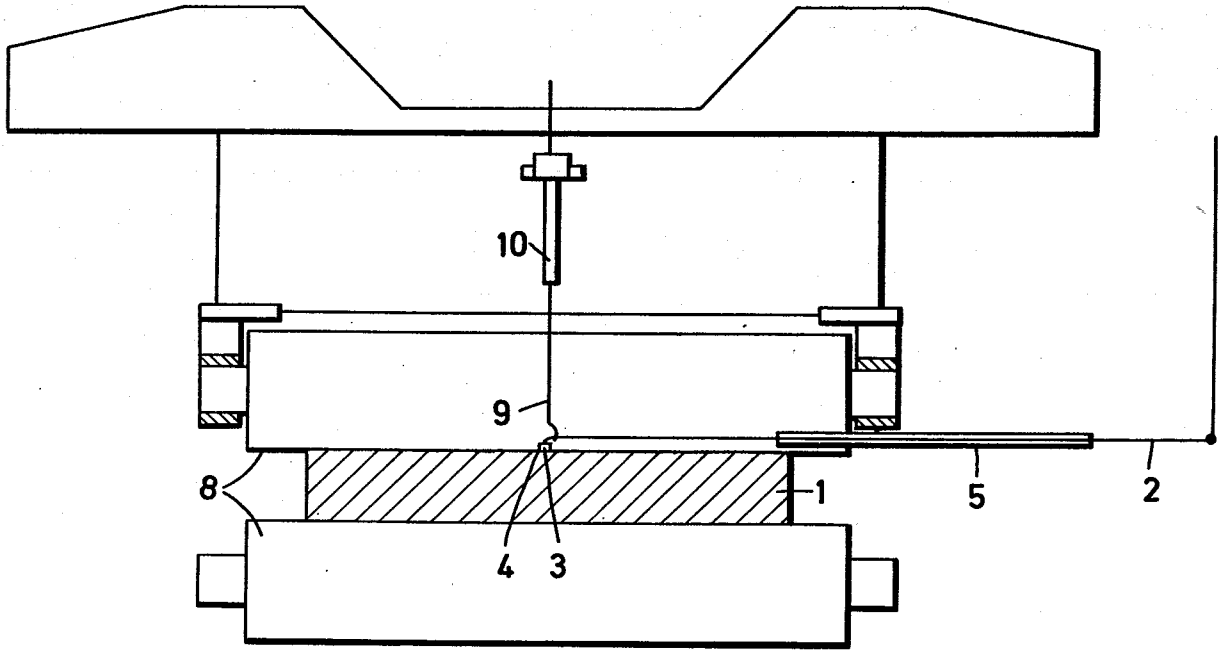
FIG. 3 is a section view through the stand just below a mold illustrating a device by means of which a thermo element is affixed to an ingot as it is being withdrawn from the mold.

FIG. 3 illustrates a rather simple and ingenious device for affixing a thermo element to the ingot. This particular threading device for placing and temporarily holding the thermo element at the surface of the ingot 1 may be a permanent piece of equipment of the casting stand and frame. Reference numeral 5 refers to a tube which projects laterally into the space between two rollers or in between the bottom of the mold and the first set of rollers underneath. Prior to casting or as soon as casting is in progress, the thermo element is placed and threaded through the small tube 5 and brought close to the center of the ingot's surface. A holder 9 positions the tip 3 of thermo element 2 with capsule 4 adjacent to ingot 1. The holder 9 is connected to a rod 10 and can be retracted. Also, the threading tube 5 will be retracted simultaneously and as soon as the thermo element sits at the ingot's surface. The thermo element will in fact be taken along by the ingot 1 due to the bonding by the just barely solidified steel skin. The retraction of the elements 9 and 5 must be fairly fast so that the thermo element is not being torn off again as soon as it is affixed to ingot 1. Following that, the first roller will force the thermo element into the ingot's surface to remain therein throughout the critical portion of travel through the cooled roller track.

The invention is not limited to the embodiments described above but all changes and modifications thereof not constituting departures from the spirit and scope of the invention are intended to be included.

We claim:

1. Method of ascertaining the effectiveness of cooling withdrawal rollers in a stand for continuous casting, the rollers being liquid cooled internally, comprising the steps of (a) affixing a thermo feeler to the surface of an ingot shortly after emerging from a mold;

(b) detecting the temperature drop that occurs as the thermo feeler passes each of the withdrawal rollers adjacent to that ingot surface; and (c) detecting whether or not the temperature drop at any of the rollers is smaller than to be expected for adequate cooling of the respective roller as an indication of insufficient cooling.

2. Method as in claim 1, including the step of detecting whether the measured drop exceeds a particular minimum.

3. Method as in claim 1, including the step of comprising the measured drop with the a reference value.

* * * * *